US009963333B2

(12) United States Patent
Stone

(10) Patent No.: US 9,963,333 B2
(45) Date of Patent: May 8, 2018

(54) PALLET-TRUCK-COMPATIBLE FLOOR-MOUNTED LOAD ELEVATOR

(71) Applicant: Robert M Stone, Tucson, AZ (US)

(72) Inventor: Robert M Stone, Tucson, AZ (US)

(73) Assignee: BISHAMON INDUSTRIES CORPORATION, Ontario, CA (US)

( * ) Notice: Subject to any disclaimer, the term of this patent is extended or adjusted under 35 U.S.C. 154(b) by 537 days.

(21) Appl. No.: 14/557,329

(22) Filed: Dec. 1, 2014

(65) Prior Publication Data

US 2016/0153607 A1 Jun. 2, 2016

(51) Int. Cl.
*B66F 9/12* (2006.01)

(52) U.S. Cl.
CPC ..... *B66F 9/122* (2013.01)

(58) Field of Classification Search
CPC ..... B66F 9/122; B65G 1/0435
See application file for complete search history.

(56) References Cited

U.S. PATENT DOCUMENTS 2,598,865 A * 6/1952 Turner ..... B66F 9/06 180/308
2,819,811 A * 1/1958 Quayle ..... B66F 9/122 414/785
2,985,328 A * 5/1961 Fitch ..... B66F 9/143 414/667
3,709,394 A * 1/1973 Strandberg ..... B66F 9/122 414/785
3,762,531 A * 10/1973 Lee ..... B65G 1/0435 198/738
3,930,587 A * 1/1976 Bliss ..... B65G 1/0407 414/664
4,128,183 A * 12/1978 Finlayson ..... B66F 9/122 187/222
4,395,190 A * 7/1983 Barchard ..... B66F 9/122 414/416.11
4,498,837 A * 2/1985 Kooi ..... B66F 9/122 187/237
6,648,581 B2 * 11/2003 Gibson ..... B65G 1/04 187/222
2003/0221914 A1 * 12/2003 Smith ..... H05K 7/1488 187/244
2009/0196720 A1 * 8/2009 Kostmann ..... B65G 1/0435 414/331.01

FOREIGN PATENT DOCUMENTS

WO WO 96/13457 A1 5/1996

* cited by examiner

*Primary Examiner* — Jonathan Snelting
(74) *Attorney, Agent, or Firm* — Antonio R. Durando

(57) ABSTRACT

A pallet-truck-compatible load elevator includes a vertical mast and a carriage coupled to the mast for vertical motion of the carriage along the mast. The retractable forks are housed in assemblies connected to the carriage and are beyond the front face of the carriage when in retracted position, such that access to the front face of the carriage is unobstructed to a pallet truck carrying a pallet. Each fork assembly includes an outer fork coupled to a support attached to the carriage and an inner fork coupled to the outer fork, the outer fork being horizontally movable with respect to the carriage and the inner fork being similarly movable with respect to the outer fork to provide telescopic extension and retraction of the fork assemblies.

13 Claims, 17 Drawing Sheets

PALLET-TRUCK-COMPATIBLE FLOOR-MOUNTED LOAD ELEVATOR

BACKGROUND OF THE INVENTION

Field of the Invention

The invention relates generally to load elevators for use in loading and unloading objects; in particular, it relates to a floor-mounted load elevator with retractable forks that render it accessible to pallet jacks.

Description of the Prior Art

In the process of handling objects, such as packages in a warehouse or a factory floor, the objects are commonly transferred manually from a pallet resting on the floor or other support to a table, a shelf, a conveyor, etc., or vice versa. Therefore, easy and ergonomic access to the objects on the pallet by a worker standing on the side of the pallet is a crucial component of the work environment in the warehouse. To that end, pallets are ordinarily placed on a load elevator of some kind so they can be lifted to render the load more accessible at the most ergonomic height possible for the workers transferring the load.

Pallets are the mainstay of shipping commerce and pallet trucks (also called pallet jacks) are the preferred method for moving palletized products on a factory floor or in a warehouse. They are relatively inexpensive and safe. Forklifts, on the other hand, are expensive and relatively dangerous; therefore, they are subject to safety regulations that require periodic training of operators and ongoing compliance with safe-practice measures, all of which increase the costs of forklift operation. For that reason many factories and warehouses limit forklift access to designated areas and only with designated certified drivers, and they forbid the use of forklifts in other areas of their premises. As a result, products like pallet trucks are the only means for transporting palletized loads to these other areas. Another disadvantage of forklifts compared to pallet jacks is the fact that they require more space to operate. Therefore, there is a need for an ergonomic lift that can be loaded or unloaded with a pallet jack rather than a forklift.

The load-elevator products devised so far in the industry have addressed these problems by adding ramps to the elevator platform in order to enable a conventional pallet jack to roll the pallet onto an elevator platform, where it is then lifted in some manner. For example, the product marketed by Bishamon Industries as the EZ Off Lifter® has an access ramp about 3 feet long that is used to roll a pallet jack about 1.75 inches higher onto the lift's fork carriage. The EZ Off Lifter® is over 8 feet long and the typical pallet truck occupies another 5 feet of space. In addition, the operator needs maneuvering room to accelerate the truck while pushing the load up the ramp or decelerate the truck when coming down the ramp with a loaded pallet. Thus, in practice, about 16 feet of floor space is required to safely maneuver a loaded pallet truck onto or off the EZ Off Lifter® and the operation of loading or unloading a heavy pallet with a pallet truck requires a substantial physical effort on the part of the operator.

Other products designed for access by pallet trucks have similar problems. For example, so-called pan lifts are lower and require a smaller ramp for access by a pallet truck, but the center of the pallet is virtually inaccessible when placed on the platform because a worker has to reach over the scissor-lift mechanism on each side of the platform. This structure is typically one foot or so wider than the pallet and the worker must reach across this additional distance to access the center of the pallet (a total of about 34", which is much more than the length of the average person's arm). In addition, the typical pan lift is about 62"-67" wide and about 60" long, a large piece of equipment to walk around while reaching for objects on the pallet. Due to the sides of the pan structure that encase the pallet, the operator must move the pallet completely outside the structure before being able to maneuver and turn the pallet truck. This requires at least 12-13 feet of floor space.

Another common problem with ramped structures lies with the fact that no ramp, however well designed, works well with all pallet trucks. Pallet truck designs vary greatly and have varying amount of underclearance. Therefore, sometime the pallet truck has insufficient clearance to go up the ramp. In addition, because at some point in the operation the drive wheels of the truck are necessarily still on the floor when its fork tips are elevated over the ramp, the resulting incline causes the fork tips to drag on the underside of the pallet's upper boards and push the pallet forward, which is very undesirable.

Yet other types of lifts (so-called E-Lifts and U-Lifts, for example) are available that do not require a ramp for access, but they are mainly for use with pallets that do not have a bottom board (so-called skids). These lifts also have external hydraulic power units with hoses and electrical lines that sit along the sides or at the end of the lift, all of which represents a hazardous obstacle for the operator.

The present invention is directed at solving these problems by providing a load elevator that is accessible by a pallet truck carrying either a pallet or a skid without the use of a ramp. The elevator has a reduced footprint for use in smaller work areas and has no structure on three sides of its extended forks, so as to enable access by the pallet truck from the front or either side of the elevator. As a result, once the pallet is in place, the operator can reach over it without any obstruction.

SUMMARY OF THE INVENTION

The invention lies in the idea of providing a load elevator with no front platform for receiving a pallet, skid, or other load. Instead, the elevator features only two retractable forks that are normally housed in the back of the lift so that a pallet can be wheeled to the front of the lift with a pallet truck without any need to overcome the obstacle of a ramp or other structure. Once the pallet is released from the truck, the elevator forks are extended frontally from a carriage assembly to engage and lift the pallet in conventional manner.

In the preferred embodiment of the invention, such pallet-truck-compatible load elevator includes a vertical mast and a carriage coupled to the mast for vertical motion of the carriage along the mast. The retractable forks are housed in assemblies rigidly connected to the carriage and are beyond the front face of the carriage when in retracted position, such that access to the front face of the carriage is unobstructed to a pallet truck carrying a pallet. Each fork assembly includes an outer fork coupled to a support attached to the carriage and an inner fork coupled to the outer fork, the outer fork being horizontally movable with respect to the carriage and the inner fork being similarly movable with respect to said outer fork to provide telescopic extension and retraction of the fork assemblies.

The preferred hardware for extending and retracting the outer fork in relation to the carriage consists of a motor-driven chain attached to the outer fork. The mechanism for extending and retracting the inner fork in relation to the outer fork is a set of cables connected to the inner fork that cause it to extend and retract with the outer fork. The outer fork, driven by the chain, provides the actuating force for also moving the inner fork. Various rollers and low-friction pressure plates and strips are provided to optimize the process of extension and retraction of the forks so that the power and the attendant space requirements required for the operation of the fork assemblies are minimized.

Various other purposes and advantages of the invention will become clear from its description in the specification that follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only one of the various ways in which the invention may be practiced.

DESCRIPTION OF THE PREFERRED EMBODIMENT

Figure 1:
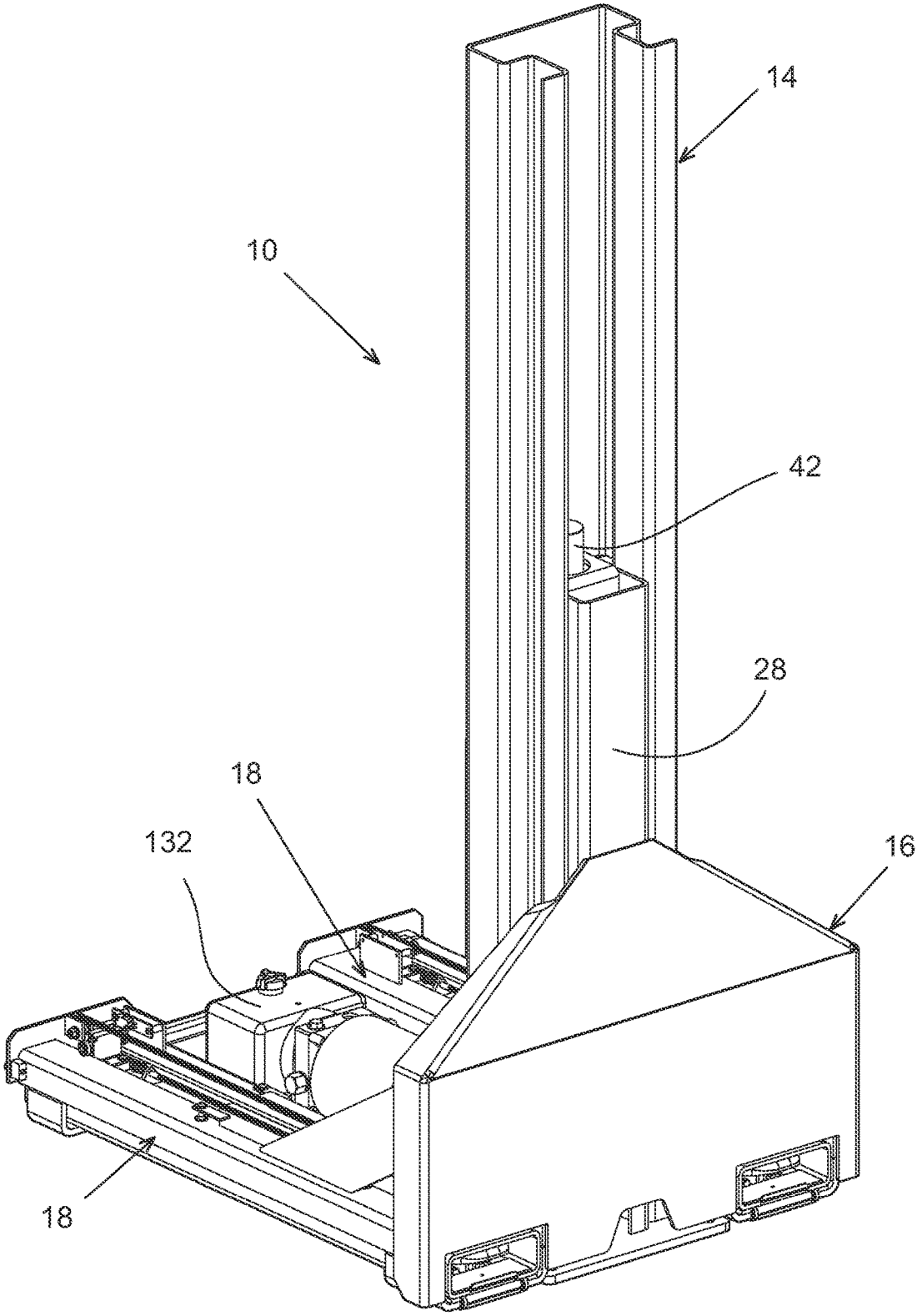
FIG. 1 is a front perspective view of a pallet-truck-compatible load elevator according to the invention shown with retracted forks.
Figure 2:
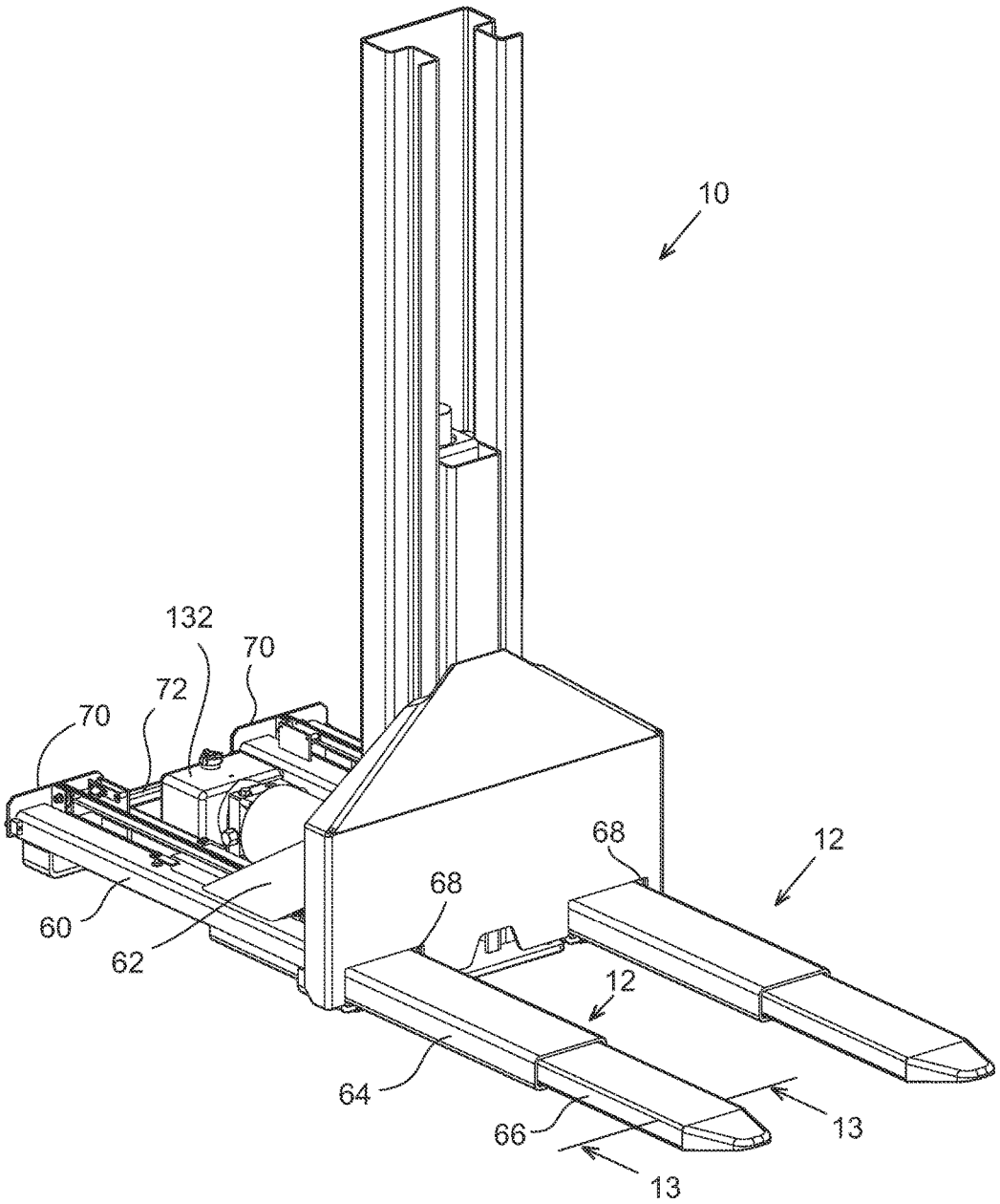
FIG. 2 is a perspective view of the load elevator of FIG. 1 shown with extended forks.

Referring to FIGS. 1 and 2, the numeral 10 identifies a pallet-truck-compatible floor-mounted load elevator in accordance with the invention. Telescopically retractable forks 12 are shown in their normally retracted position in FIG. 1 and in their extended position in FIG. 2. The elevator 10 includes three basic components: a vertical mast 14 that is bolted to the floor, a carriage 16 that is coupled to the mast for vertical motion, and two spaced-apart fork-assembly structures 18 that are connected to the carriage 16 and house the retractable forks 12 and the mechanisms for extending them to engage a pallet and retracting them for the release of the pallet. As used herein, the term longitudinal always refers to the direction of the major axis of the structural component being discussed. With reference to the retractable forks described below, for example, longitudinal refers to the direction of extension and retraction of the forks. Also, any reference to pallets is intended to include skids as well.

Figure 3:
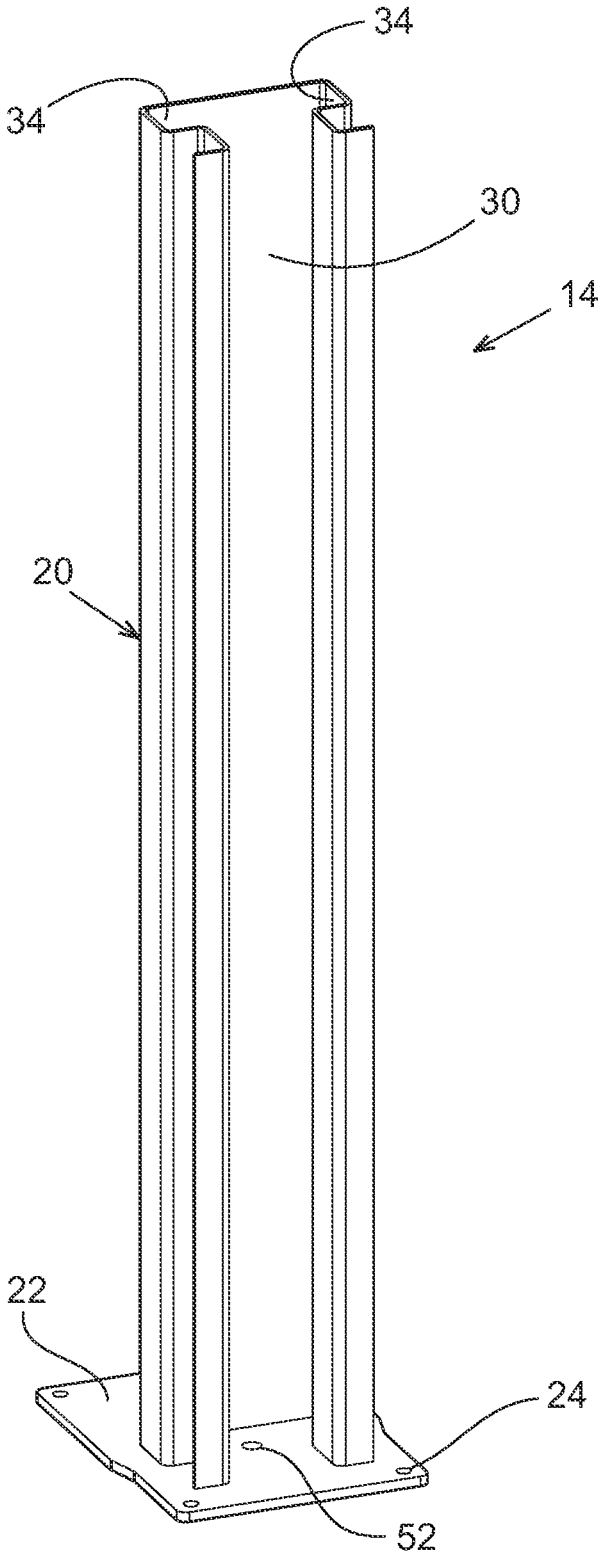
FIG. 3 is a front perspective view of the mast component of the load elevator of FIG. 1.

As illustrated in FIG. 3, the mast 14 (also referred to herein as post) is a vertical channel structure 20 formed from a steel plate (such as 3/16" steel), approximately 77" tall and attached to a base plate 22. Rear gusset plates (not shown) are used in conventional manner to gusset the vertical post to the base plate. It is anticipated that concrete anchor bolts (also not shown) will be used through apposite through holes 24 in the base plate to secure the mast 14 to a concrete floor on the work premises, such as a warehouse floor. It is understood, though, that other means of fastening as well as other support structures for the mast 14, such as ground footings or other support frame encased on a ground floor, could be used to support the mast.

Figure 4:
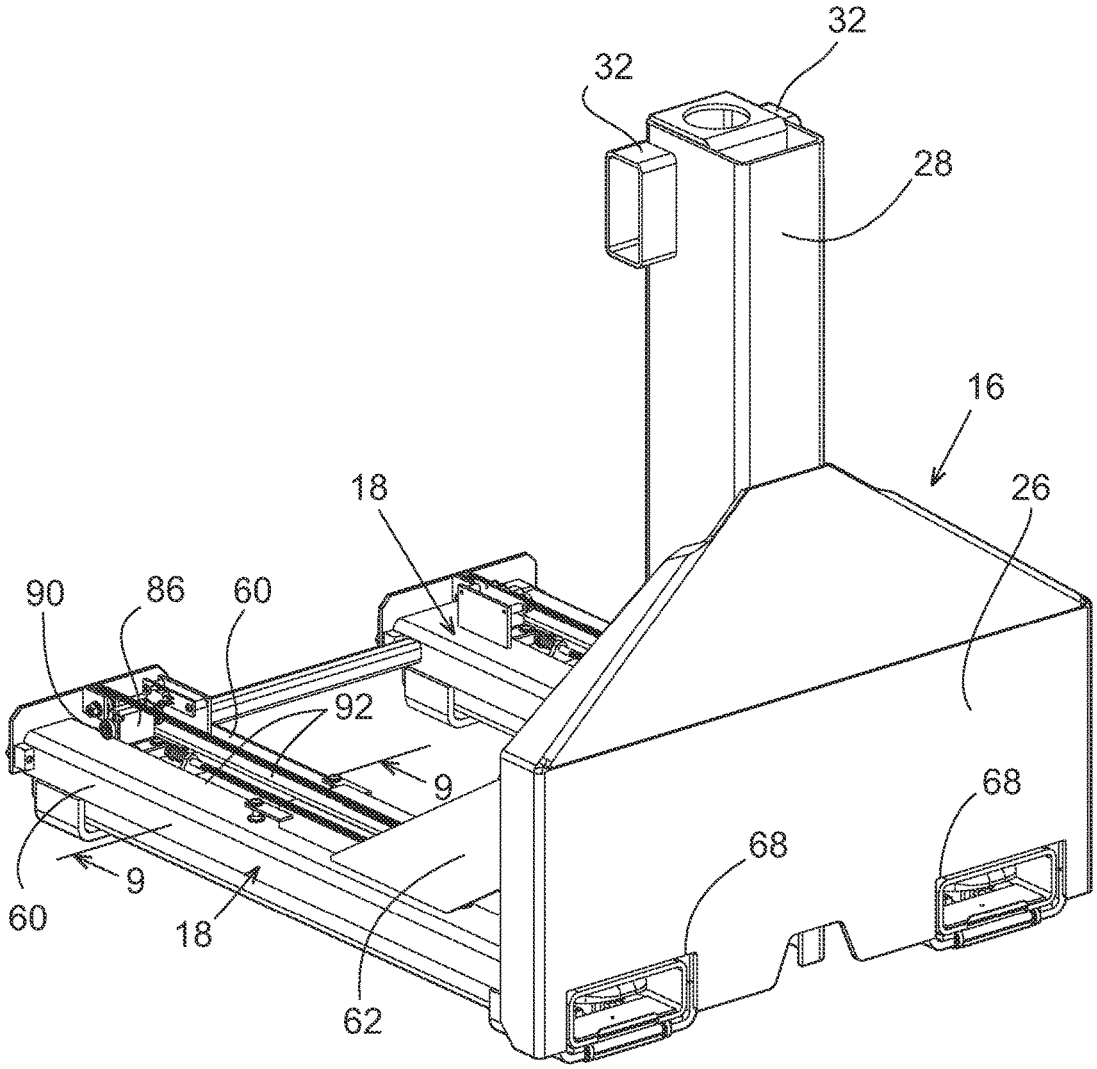
FIG. 4 is a front perspective view of the carriage of the load elevator of FIG. 1, including the retractable forks housed in fork assemblies attached to the carriage.
Figure 5:
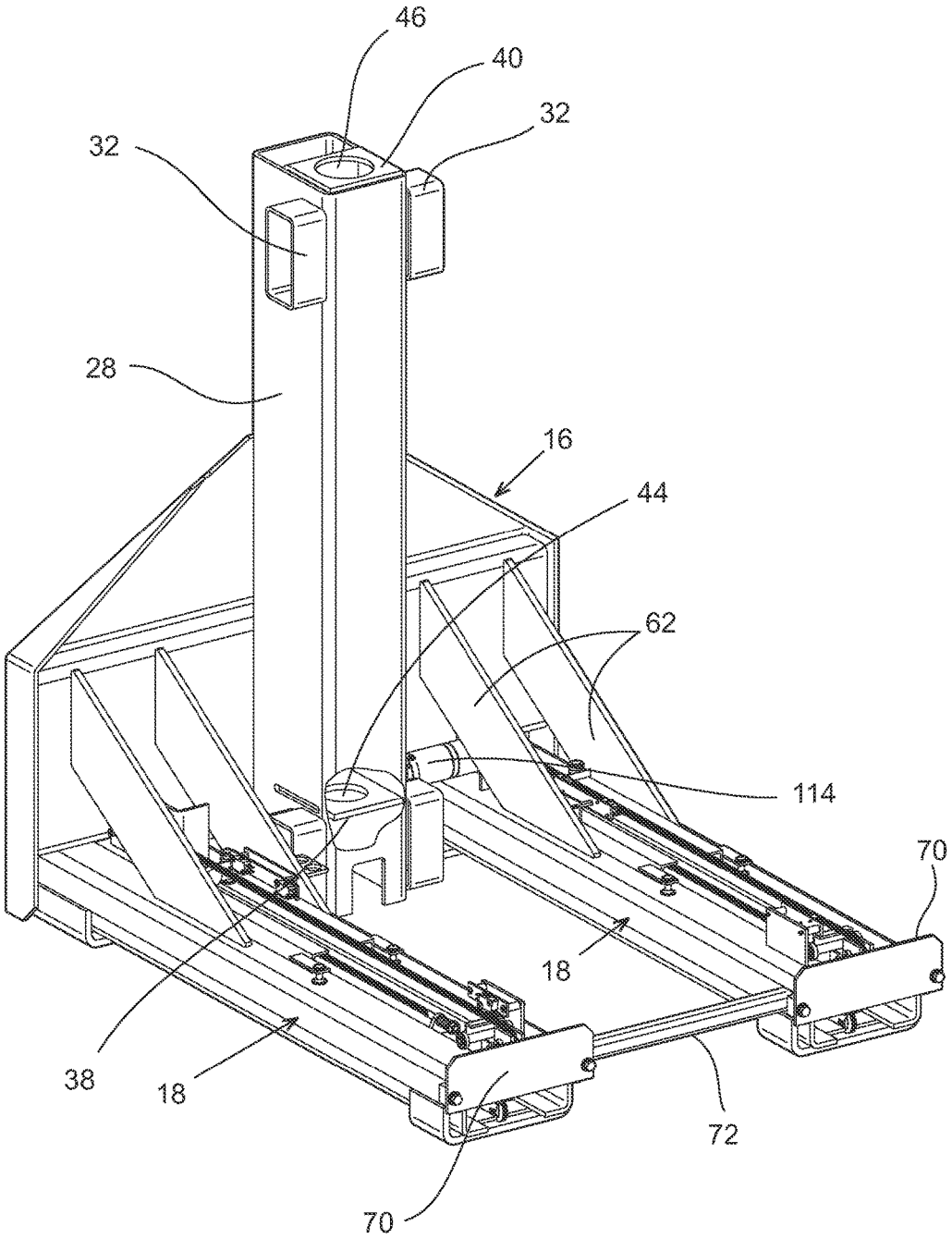
FIG. 5 is a perspective view of the carriage of FIG. 4 taken from the back, including a cut-out portion to show the bottom plate inside the vertical beam of the invention.
Figure 6:
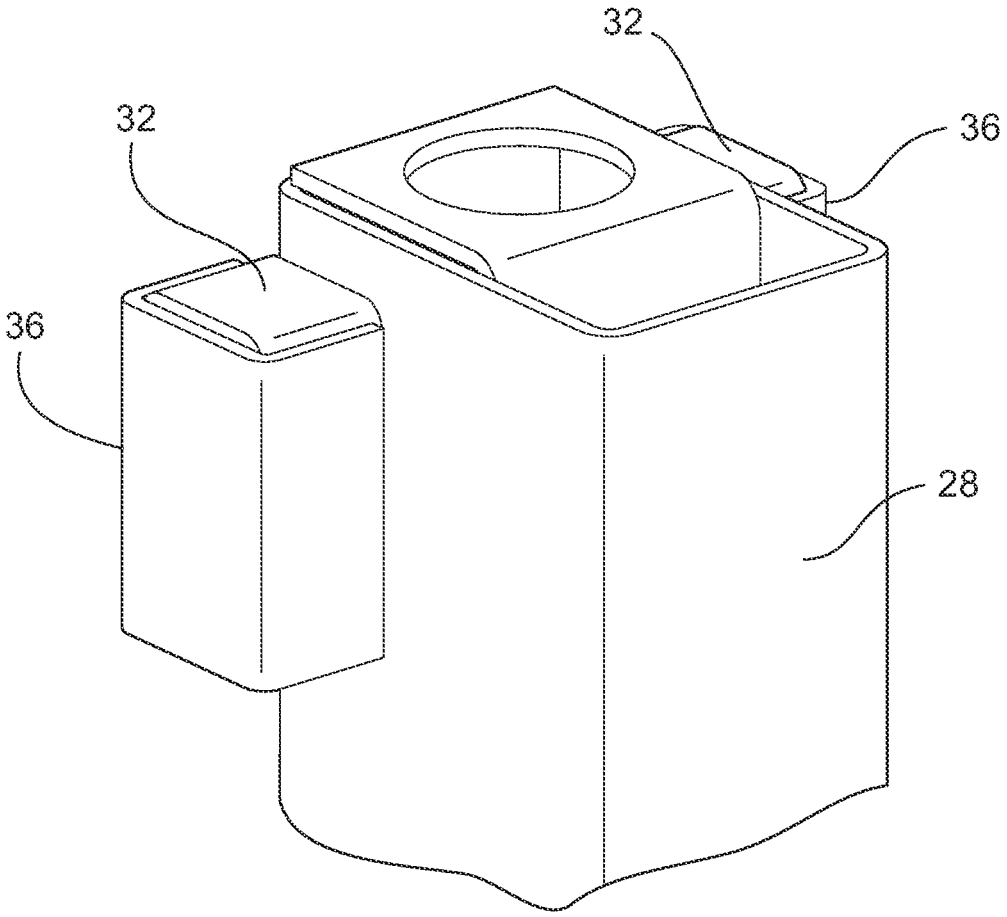
FIG. 6 is a more detailed perspective view of the top portion of the carriage beam, including two of the slide blocks that interface with the vertical channel structure of the mast.
Figure 7:
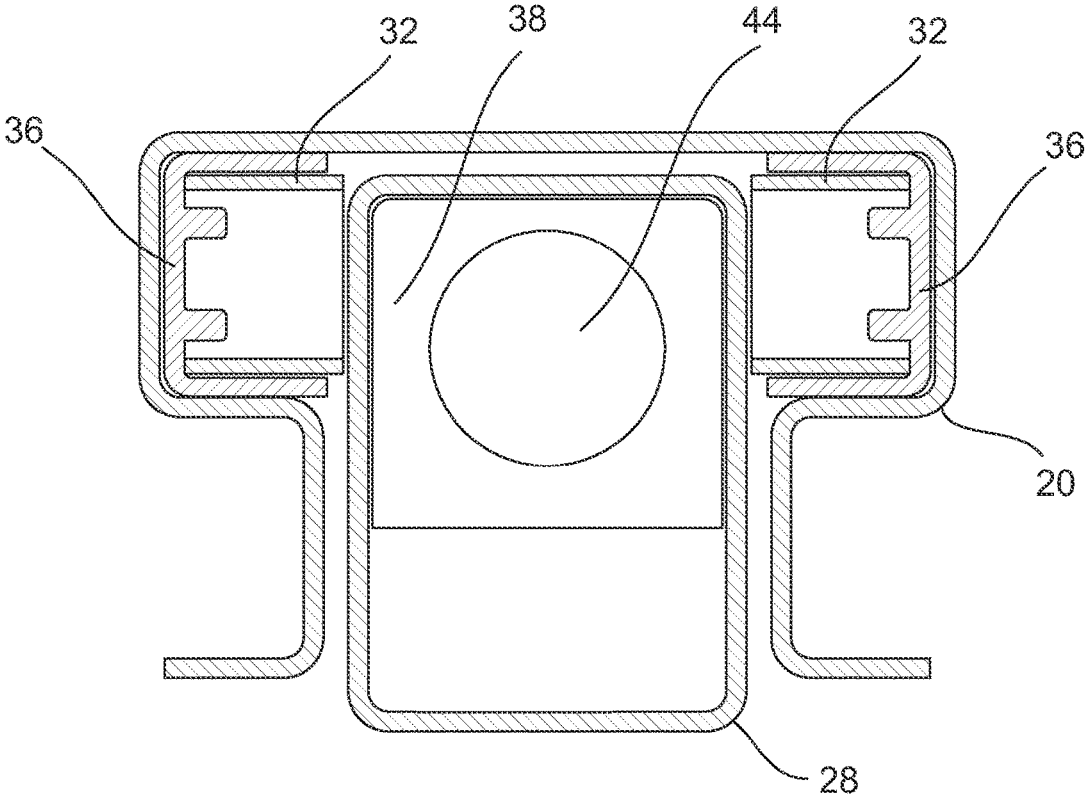
FIG. 7 is a top cross-section view of the top portion of the carriage beam shown in FIG. 6 after engagement by the mast's vertical channel structure shown in FIG. 3.

FIGS. 4 and 5 illustrate the carriage 16 and the fork-assembly structures 18 attached to it. The forks 12 are shown in retracted position. Focusing first on the carriage 16, it includes a front plate 26 rigidly attached to a beam 28 of rectangular cross-section that is sized to fit within the center channel 30 of the mast 14. The beam 28 has four tubular sliders 32 attached to it laterally at the top and bottom of the beam. The sliders 32 are designed to fit loosely within the two side channels 34 of the vertical channel structure 20 of the mast 14. As illustrated in the partial view of FIG. 6, a plastic slide block 36 is fitted around the vertical sides of each slider 32 and also inside the tubular portion of the slider to keep the block securely attached it. The blocks 36 provide the sliding interface between the beam 28 and the mast 14. FIG. 7 shows in top cross-sectional view through the top sliders the working connection between the beam 28 of the carriage and the channel structure 20 of the mast. The only contact along the vertical surfaces of either is through the slide blocks 36 at the top and bottom of the beam 28. Two horizontal plates 38 and 40 inside the beam 28 of the carriage (see FIG. 5) provide support for a hydraulic cylinder 42 fitted in respective openings 44 and 46 of the plates for lifting the carriage 16, as detailed below.

Figure 8:
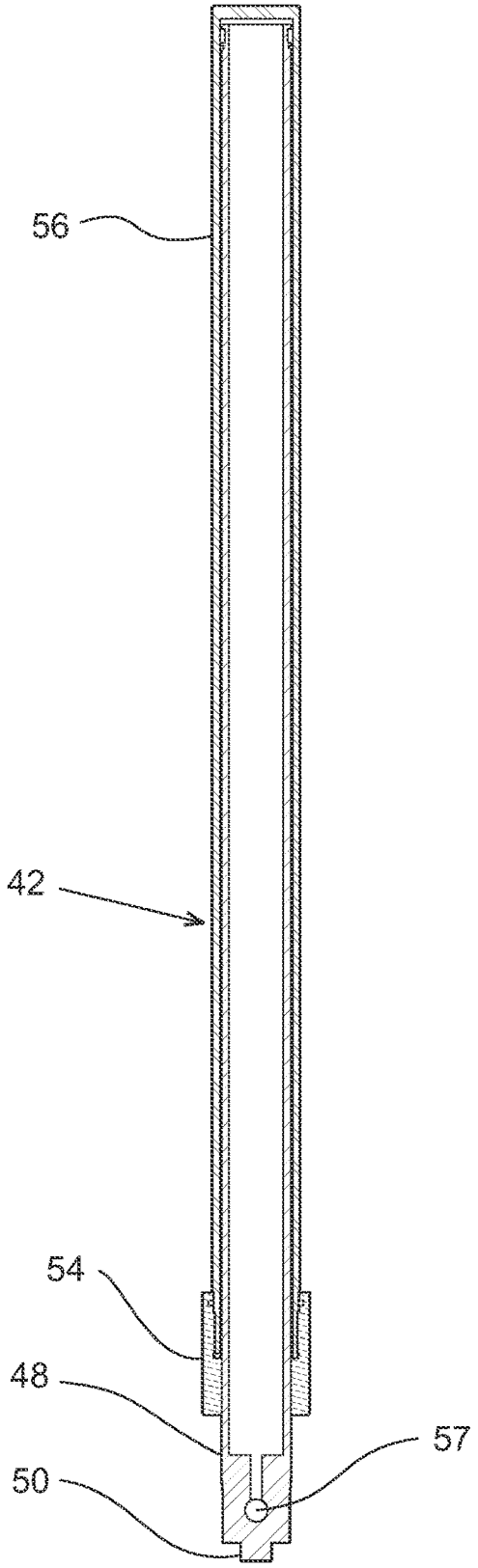
FIG. 8 is a cross-section view of a hydraulic cylinder fitted for lifting the carriage of the invention.

When the carriage is installed into the mast, the cylinder 42 (a conventional hydraulic ram shown as a separate item in FIG. 8) sits inverted in the openings 44 and 46 through plates 38 and 40, respectively. The down facing rod 48 of the cylinder 42 is coupled to the base plate 22 of the mast by inserting the projection 50 at the tip of the rod into a receiving perforation 52 in the plate (FIG. 3). A carriage interface structure 54 attached to the bottom of the cylinder's barrel 56 supports the lower plate 38 in the carriage when fully lowered into place. Thus, as the cylinder extends, the carriage is lifted by the cylinder through this connection between the interface structure 54 attached to the rising barrel 56 and the bottom plate 38 attached to the carriage. As seen in FIG. 1, the cylinder 42 is slightly longer than the beam 28 of the carriage so as to protrude through the upper plate 40, which is used only to guide the cylinder. Hydraulic fluid is provided to the cylinder through a rear-facing opening 57 in the rod, which is hollow, at the bottom of the cylinder. This configuration provides a direct-thrust cylinder arrangement that is cost effective and well proven in the art. However, it is understood that this lifting arrangement is not critical to the invention and many different arrangements could be employed.

Turning now to the fork assemblies 18 (see FIGS. 1 and 2), they represent the novel concept of the invention: the fact that each fork is retractable behind the carriage, thereby eliminating the need for ramps and reducing the space required to load and unload pallets and skids. Each assembly 18 is spaced apart from the other fork assembly to the degree necessary to engage conventional pallets and skids, incorporates a telescopically retractable fork 12, and is connected independently to the carriage 16 for engaging and lifting pallets and skids in conventional manner. Both assemblies are exactly the same, so a single one is described in detail here. As seen in FIGS. 2, 4 and 5, each fork assembly 18 includes two outer guide angles 60 extending rearward from the back of the front plate 26 of the carriage. Respective gussets 62 connecting the guide angles 60 to the carriage provide a strong structural support for the fork assembly. As also shown in cross section in FIG. 9, each guide angle 60 consists of an inverted L-shaped structure with the front preferably welded to the back side of the plate 26 in the carriage, in longitudinal alignment with an opening 68 for the extraction of the forks 12 on each side of the bottom of the carriage. A back plate 70 tying the back ends of the two guide angles 60 in each assembly and a bar 72 connecting the two fork assemblies 18 provide a rigid stationary structure for housing and supporting the movable components of the retractable forks, as illustrated below.

Figure 9:
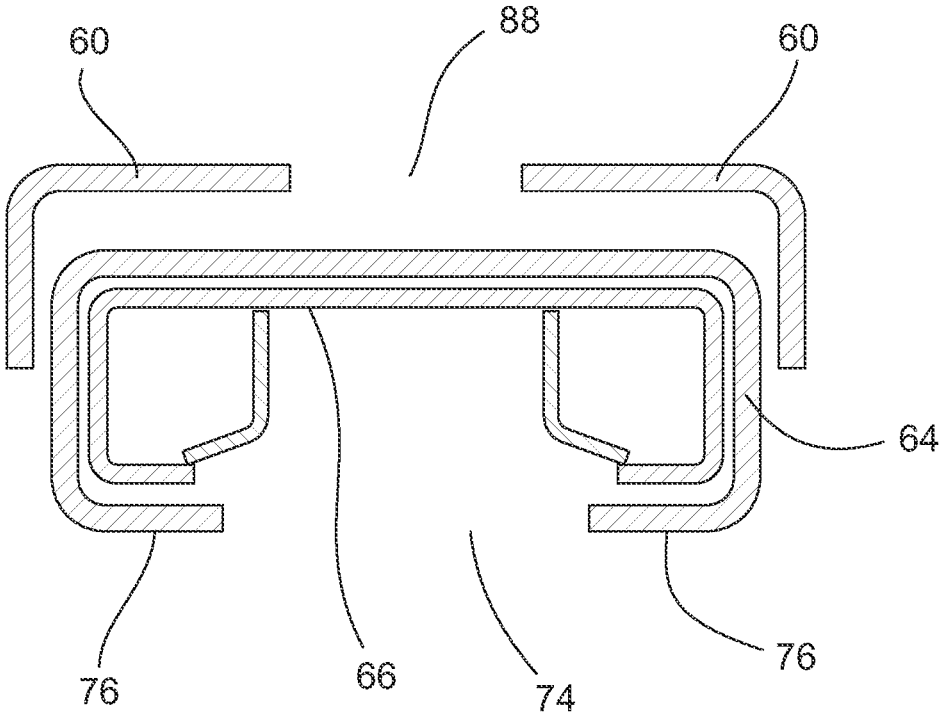
FIG. 9 is a cross-section taken along lines 9-9 in FIG. 4, wherein the only structures shown are the angle guides, the outer fork bounded by it, and the inner fork within the outer fork.

Each retractable fork 12 comprises an outer fork 64 and an inner fork 66 (see FIG. 2, for example). The outer fork is supported by the stationary guide angles 60 by means of rollers that allow it to move longitudinally in and out of the guide-angle structure. As seen in FIG. 9, the outer fork 64 has a substantially rectangular cross-section with a central longitudinal opening 74 at the bottom that defines two lateral rails 76. Based on this configuration, the outer fork 64 is supported at the front end by two front rollers 78 mounted on a flexible support plate 80, shown in FIG. 10, bolted in longitudinally cantilevered fashion to the underside of the inverted channel structure 82 that defines each opening 68 in the carriage. The support plate 80 is bolted distally from the front of the carriage so as to be cantilevered forward. The bottom sides of the rails 76 of the outer fork 64 ride on respective rollers 78 which, prior to placing a load on the extended forks, support the outer fork above the underlying structure, thereby permitting its longitudinal motion essentially without friction. When the extended forks are lifted with a loaded pallet, the flexible support plate 80 flexes downward causing the rails 76 to bear against a lower-front pressure plate 84 designed to support the fork under full load. The plate 84 is preferably made of ultra-high-molecular-weight (UHMW) plastic, usually polyethylene, which has a low friction coefficient and is capable of carrying high compressive loads, an ideal material for distributing pressure forces from the outer fork to the carriage.

Figure 10:
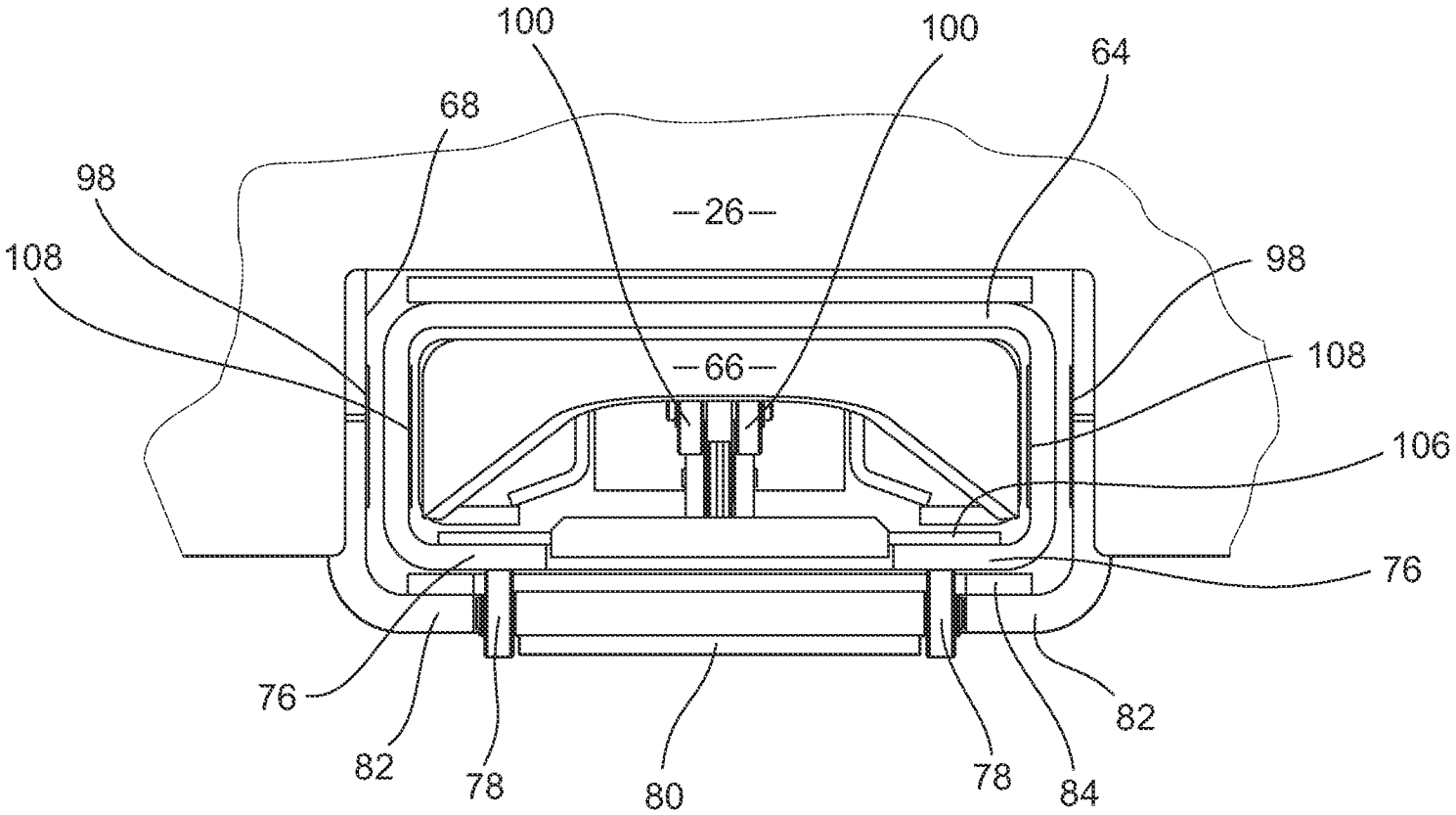
FIG. 10 is a partial view of the front side of one of the fork assemblies of the invention showing retracted outer and inner forks, including the front rollers that support the outer fork.
Figure 11:
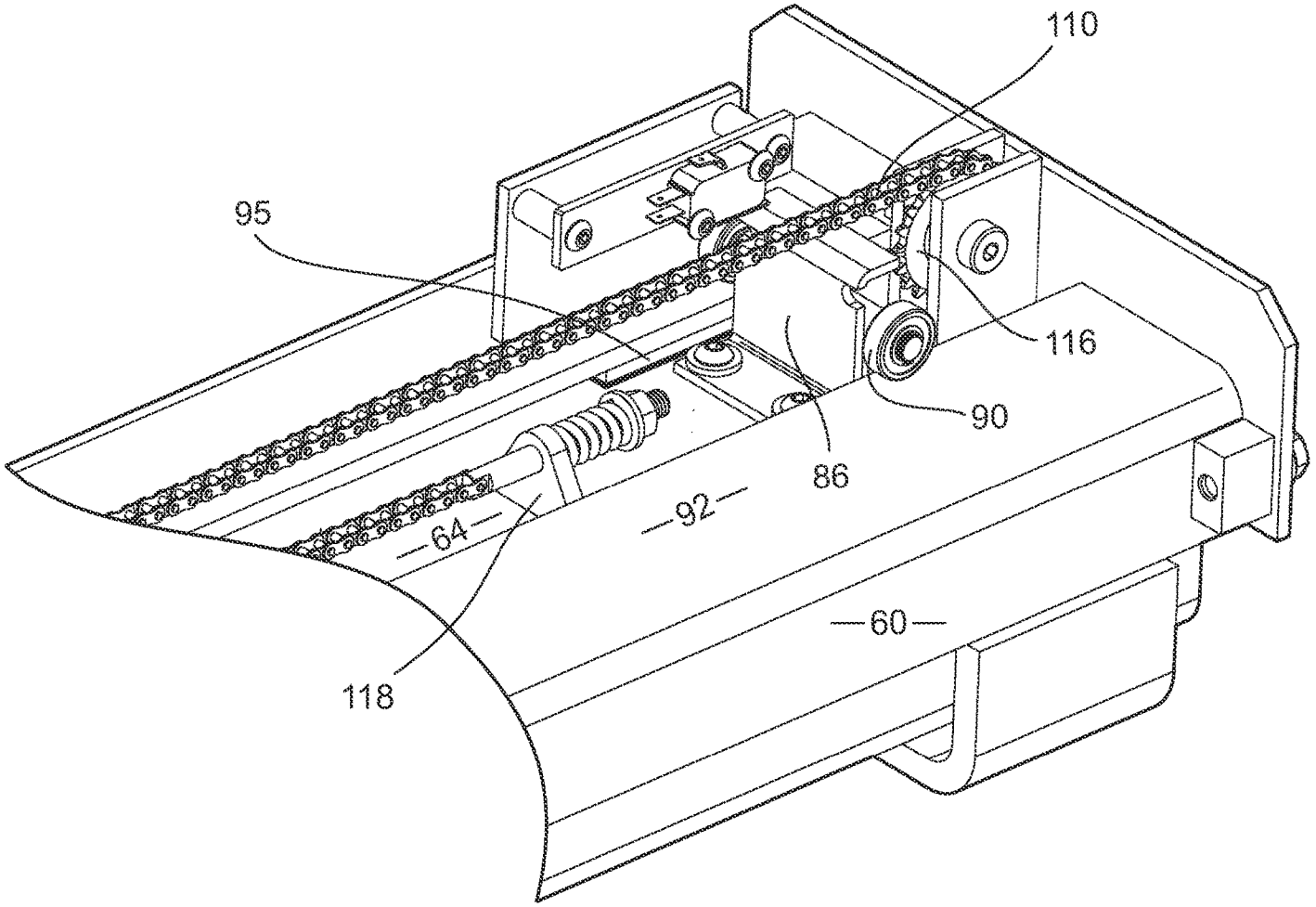
FIG. 11 is a perspective view of the upper back side of one of the fork assemblies of the invention showing, in retracted position, the back rollers that support the outer fork.
Figure 12:
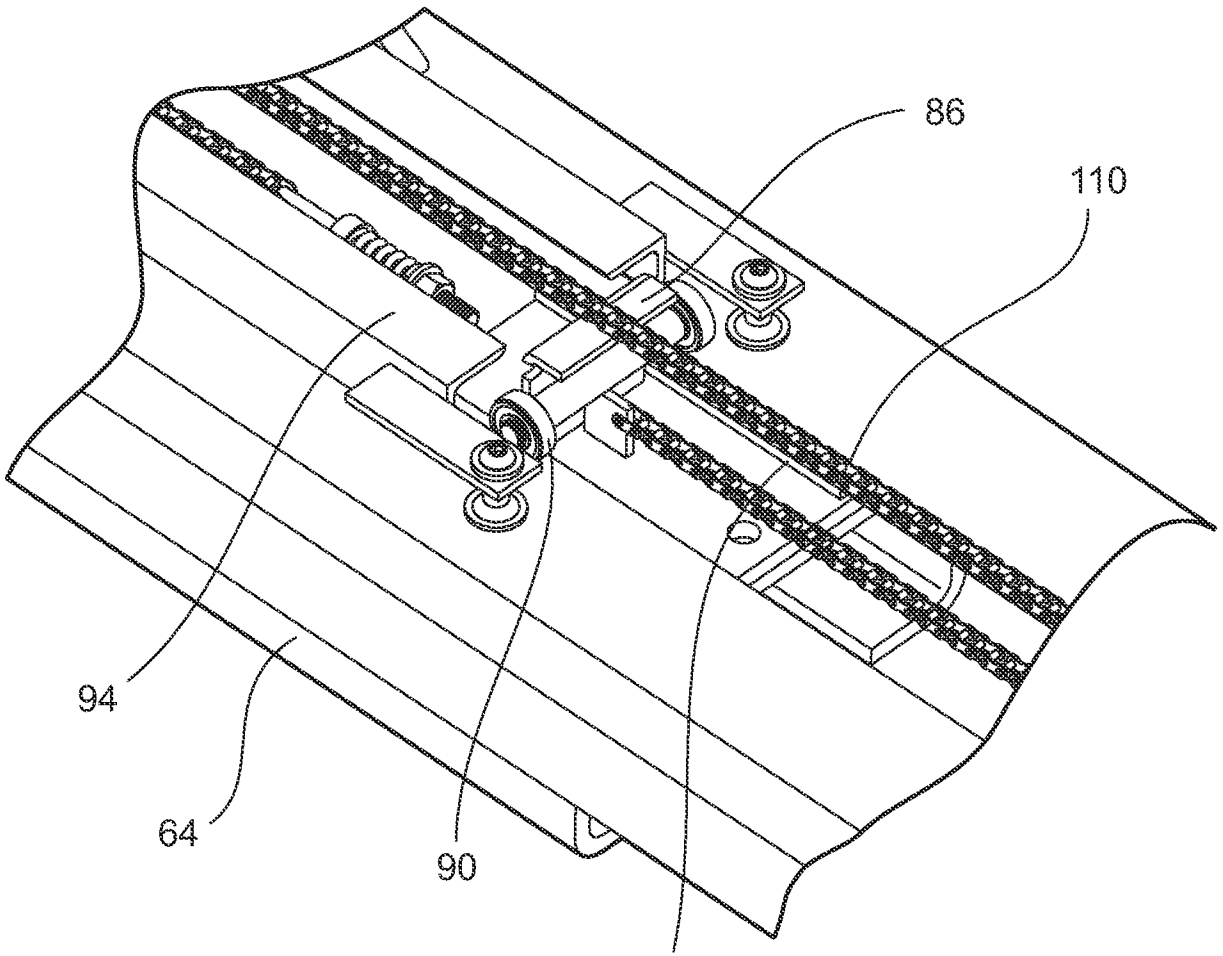
FIG. 12 is a perspective view of the upper middle side of one of the fork assemblies showing, in partially extended position, the track that engages the back rollers of FIG. 11 as they travel forward.

Referring to FIGS. 4 and 11, in particular, the support of the back end of the outer fork 64 by the angle guides 60 is illustrated. A vertical bracket 86 is attached to the back end of the outer fork 64 and extends upward through the longitudinal opening 88 (FIG. 9) defined by the spacing between the guide angles 60 of each fork assembly. Two back rollers 90 supported transversely by the bracket 86 are aligned with and bear on respective longitudinal runs 92 on the top surface of the angle guides. Thus, the outer fork, supported by rollers 78 up front and rollers 90 in the back, is free to extend out and retract back in through the opening 68 in the carriage with only rolling friction in spite of its heavy-duty construction and multiple cooperating parts. In the preferred embodiment, the stationary angle guides 60 are slightly longer than 38 inches measuring from the plate 70 to the opening 68 at the front of the carriage. The outer fork 64 is slightly less (about 38 inches long) and it is designed for a maximum extension of 24 inches in front of the carriage, thereby positioning the back end of the outer fork substantially under the connection between the angle guides 60 and their respective gussets 62, so as to provide the best structural design for supporting heavily loaded forks. As the outer fork 64 travels out of the front opening 68, it reaches a tipping point where its forward weight (including the weight of the inner fork contained within it) exceeds the backward weight still behind the front rollers 78. At that point, the fork tends to tip down causing the back rollers 90 to lift upward and no longer support and guide the back end of the outer fork. Therefore, as shown in FIG. 12, a square track channel 94 is incorporated at the appropriate place along the travel of each back roller 90 to trap the rollers and provide an upper surface against which the lifted rollers can bear during the remaining portion of travel. Just enough clearance is allowed between the upper surface of the guide angles and the bottom surface of the roller track channels for the rollers 90 to roll freely, which results in little change in the vertical position of the tip of the extended outer fork. Two UHMW, upper-rear pressure plates 95 are preferably also attached to top of the back end of the outer fork (shown in FIGS. 11, 12, 14 and 15 placed over a black shim stack) so that they can bear against the interior horizontal surface of each angle guide when the fork is in its extended position and loaded. However, sufficient clearance between the top surface of the pressure plates and the underside of the guide angles prevents contact between them until the forks are fully extended and loaded. In order to ensure that the pressure plates 95 bear totally against the underside of the angle guides without interference from the back rollers 90 bearing against the upper surface of the track channels 94, the front end of the track channels is preferably attached to the angle guides with a spring loaded connection 96 (also seen in FIGS. 14-15) that allows the front of the channels to flex vertically sufficiently to enable full contact between the rear pressure plates 95 and the angle guides. Any friction caused by potential contact between the sides of the outer fork 64 and the angle guides is minimized by inserting strips 98 of low-friction UHMW material in the lateral gaps therebetween, as seen in FIG. 10. The motion of the outer fork 64 in relation to the carriage and the mechanisms that produce it are discussed further below.

Figure 13:
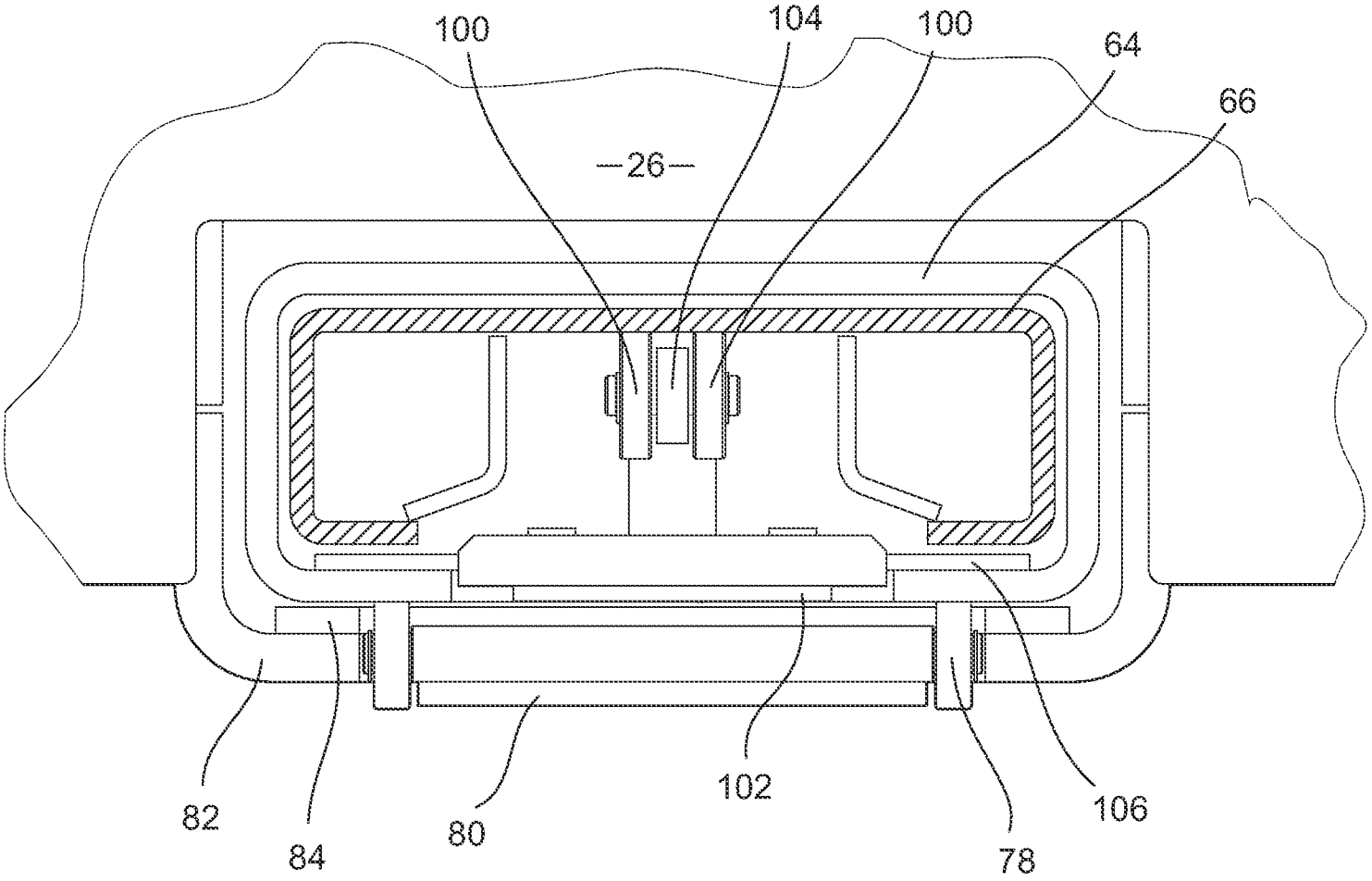
FIG. 13 is a partial view of one of the fork assemblies showing a cross section of the inner fork taken along lines 13-13 in FIG. 2, including the interior rollers that support the inner fork.

The inner fork 66 is similarly coupled to the outer fork 64 and movable with respect to it for the full extension of each telescopically retractable fork 12. As illustrated in FIG. 13, where both forks are shown fully extended, the inner fork 66 is supported upfront by a set of interior rollers 100 attached to the bottom front of the outer fork 64 where a plate 102 is bolted to the underside and overlaps the longitudinal opening 74 of the outer fork (see also FIG. 9). The interior rollers 100 rotate about an axle supported by a flexible beam 104 that is cantilevered from a structure (not seen) attached to the plate 102. A slight flex in the beam 104 urges the rollers 100 against the bottom surface of the inner fork 66, thereby providing rolling support for the inner fork at the front end of the outer fork 64. An upper-front pressure plate 106 (seen more clearly in FIG. 13) is provided in front of the rollers 100 for engagement by the bottom of the inner fork when fully extended and loaded. The upper force exerted by the beam 104 is sufficient to prevent contact between the bottom of the unloaded inner fork and the pressure plate 106, so that the extension of the inner fork is substantially frictionless. However, the flexibility of the beam 104 also allows the rollers 100 to be lowered to cause the inner fork to bear fully on the pressure plate 106 when loaded, such that the pressure plate distributes the resulting compressive forces to the outer fork 64. The back end of the inner fork 66 is not supported by rollers; instead, it is simply allowed to slide in contact with the upper interior surface of the outer fork 64. However, a UHMW, lower-rear pressure plate 107 (also seen in FIGS. 14 and 15 over a black shim stack) is also used to press against the interior of the outer fork when the inner fork is fully extended and loaded. This design choice was made because of the relatively low weight of the inner fork and the attendant small force (about 20 pounds) that is required to cause the inner fork to slide in view of the rolling support provided at the front end of the outer fork. Strips 108 of low-friction UHMW material are also preferably placed in the lateral gaps between the inner and outer forks, as shown in FIG. 10, in order to reduce friction caused by potential contact between the two structures. The inner fork 66 is about 35.5 inches long and it is also designed for a maximum extension of 24 inches in front of the outer fork 64. Thus, the forks 12 protrude a total distance of 48 inches when fully extracted, which is the length of the forks of typical pallet trucks.

Since the inner and outer forks always move from their retracted position to their extended position and back with no load (other than their weight), the portions of the guide angles 60 extending beyond the gussets 62 are substantially not structural. The gussets 62 with the angle guides 60 and the front plate 26 of the carriage form a force triangle that constitutes the structural connection of the fork assemblies to the carriage. When the forks are at maximum extension, the outer fork 64 bears against the front pressure plate 84 which, in turn, bears against the channel structure 82 (FIG. 10) that is structurally tied to the carriage. Through respective pressure plates, the rear of the outer fork 64 bears against the guide angles 60, which are structurally gusseted to the carriage, and the rear of the inner fork 66 bears against the outer fork. Thus, the combination of these component connections provides a structural configuration that makes it possible to have telescopic forks that can be stored entirely beyond the front plate 26 of the carriage while maintaining the ability to lift a fully loaded pallet engaged by the forks without a support platform and without ramps to position the pallet.

Figure 14:
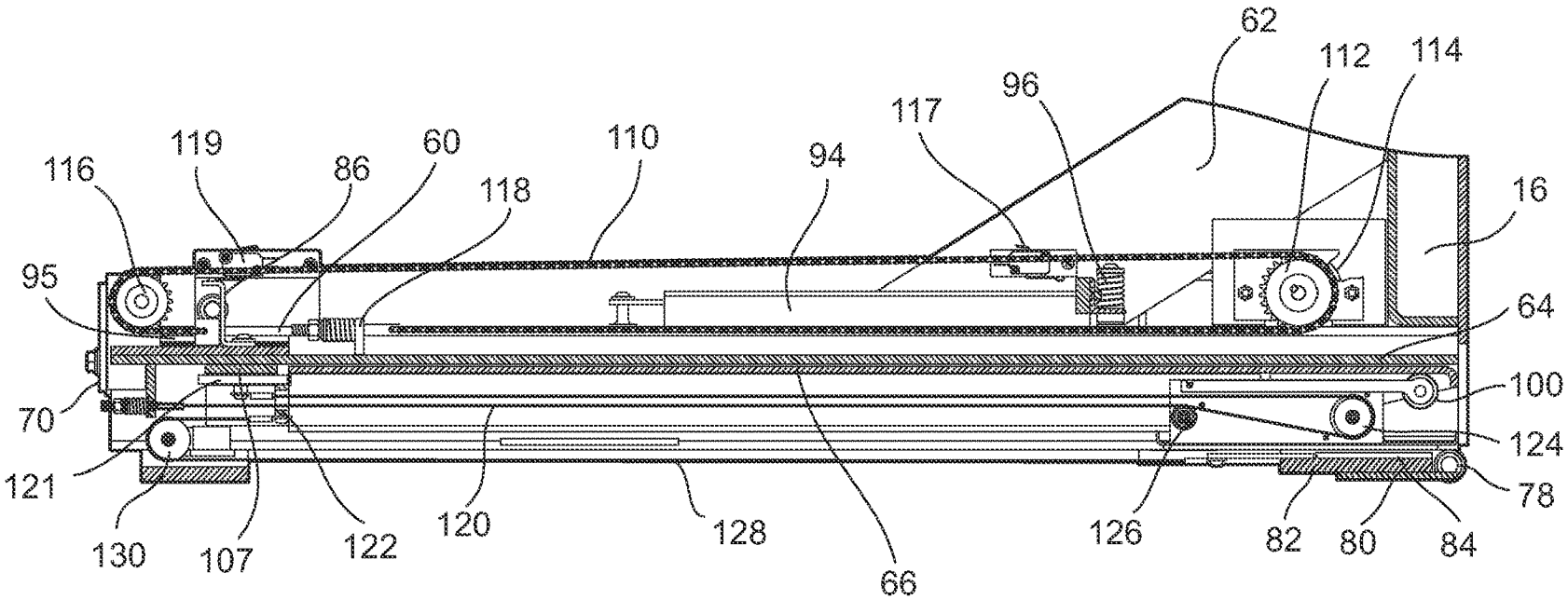
FIG. 14 is a cross-section view of one of the fork assemblies taken along its longitudinal center when the outer and inner forks are retracted.
Figure 15:
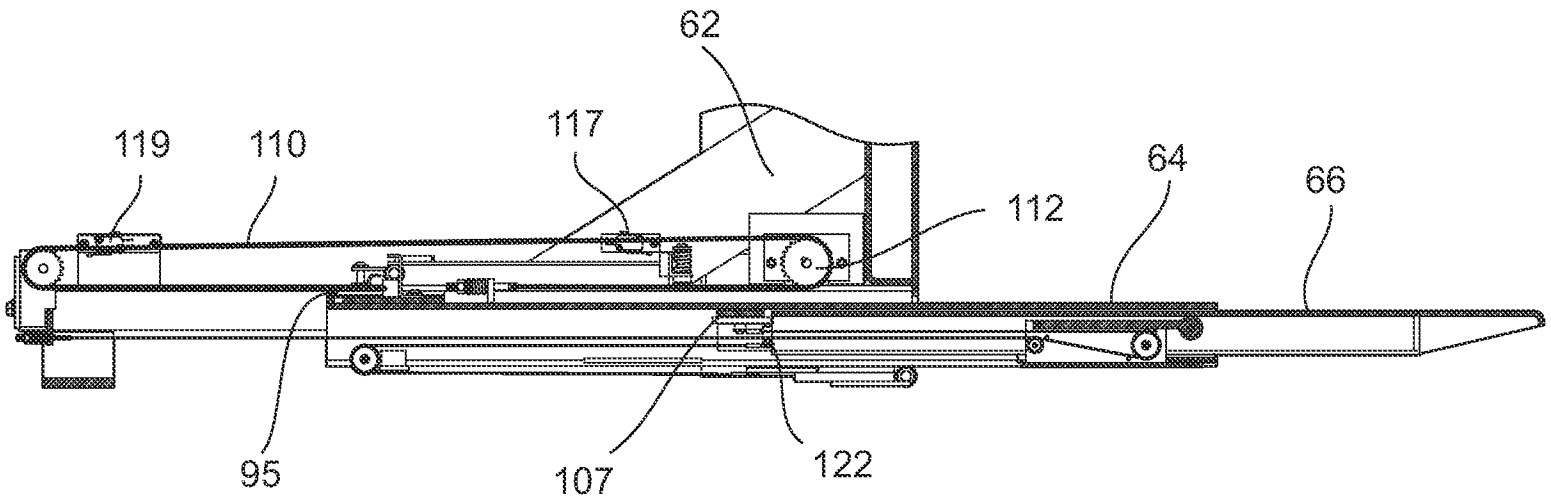
FIG. 15 is the same as FIG. 14 but taken when the outer and inner forks are partially extended.

The motion of the various components of the fork assemblies 18 will be described in relation to each other. As stated above, the angle guides 60 are stationary, rigidly attached to the carriage 16 of the invention. The outer fork 64 moves longitudinally with respect to the angle guides 60 from a retracted position (FIG. 1), where it is walled by the angle guides, to an extended position (FIG. 2), where about ⅔ of the length of the outer fork protrudes in front of the carriage. As illustrated in FIG. 14, a cross-section view of one of the fork assemblies 18 of FIG. 1, the motion of the outer fork 64 in relation to the stationary angle guides 60 is produced by a closed-loop chain 110 driven at one end by a drive sprocket 112 coupled to a motor 114 (seen in FIG. 5) mounted on a plate that is attached to the guide angle 60 and the gusset 62. Best mounted off the chain assembly approximately next to the gusset 62. At the other end of the loop, the chain 110 is engaged by an idler sprocket 116 mounted distally on the plate 70 tying the ends of the angle guides 60. As shown also in FIGS. 11 and 12, one end of the chain is attached to the bracket 86 of the outer fork 64 while the other end is connected in spring-loaded fashion to an anchor 118 that is also attached to the top of the outer fork 64. The spring action is provided to cushion the impact in the event the fork hits an obstruction. As the drive sprocket 112 is turned counterclockwise, the chain 110 pulls the outer fork 64 forward to extract it from the assembly 18 until a limit switch 117 (see FIGS. 14 and 15) stops the motor 114. FIG. 15 illustrates the fork assembly in partially extended position. The reverse occurs of course when the drive sprocket 112 is turned clockwise and another limit switch 119 is activated to stop the travel of the fork.

A similar arrangement is provided for the motion of the inner fork 66 in relation to the outer fork 64, but a cable system is used instead of a chain. One end of an extend cable 120 (a wire rope) is attached to the underside of a horizontal plate 121 at the rear end of the inner fork 66 and is passed through a hole in a vertical plate 122 to extend forward in the interior void of the inner fork. The extend cable 120 then wraps around a large extend pulley 124 and over the top of an idler pulley 126 before extending backward toward the rear of the machine, passing through the hole in the inner fork's vertical plate 122, and connecting to the back plate 70 of the assembly, also with a spring-loaded attachment to absorb potential shocks. The large cable pulley 124 and the idler pulley 126 are both attached to the bottom of the outer fork 64 and move in and out with the outer fork. Thus, when the chain 110 pulls the outer fork forward, in turn it also moves the wire rope pulleys forward. Since the inner fork's extend cable 120 wraps around the pulley 124 and is connected to the back plate 70, the inner fork 66 extends from the face of the carriage at a 1:1 ratio with respect to the outer fork 64 and a 2:1 ratio with respect to the carriage. Likewise, a retract cable 128 is attached at one end to the bottom of vertical plate 122 at the back of the inner fork, extends rearward and wraps over a rear retract pulley 130 that is attached to the back of the outer fork 64. The cable 128 then extends forward and is attached to the bottom of the carriage 16. The retract system is functionally identical to the extend system, except in reverse. That is, when the chain 110 pulls the outer fork backward from its extended position, it also moves the pulley 130 backward. Since the retract cable 128 wraps around the pulley 130 and is connected to the carriage 16, the inner fork 66 is pulled back by the retract cable attached to the vertical plate 122.

As a result of the low-friction configuration of the fork assemblies, the linear motion of the forks can be produced by a relatively small motor that can therefore be fitted behind the carriage to maintain the low footprint design of the invention. In the preferred embodiment, the motor 114 (seen in FIG. 5, for example) is a medium-torque, 24 VDC, gear motor mounted just behind the carriage face in alignment with the sprocket 112. An ANSI size 25 roller chain 110 was found to be optimal to drive the outer fork 64 in and out of the carriage. A 1/16"-diameter wire rope was found to be optimal for both the extend and the retract cables that drive the linear motion of the inner fork 66. The hydraulic function of the elevator is supplied by a conventional pump/motor combination 132 that is connected to the cylinder 42 from the back of the carriage, as seen in FIGS. 1 and 2. The pump/motor combination is preferably mounted to plate 22 behind the mast 20 (FIG. 3) and placed between the fork assemblies (FIG. 1). The vertical travel of the forks has a range of 34 inches, which is deemed efficient for an operator to handle loads from and to the pallet and safe (so that a person will not normally be under the elevated forks). Limit switches to the carriage travel are also preferably added for safety in conventional manner. Finally, appropriate conventional controls and alarms are provided for a person to safely operate the load elevator in all its functions.

Thus, a new kind of load elevator has been disclosed that makes it possible to lift a pallet without the use of a forklift to position the pallet within the reach of the elevator. The advantages of the invention include a very small structural footprint, never before attained in the art for a lift capable of lifting a loaded pallet weighing as much as 2500 lbs; an unobstructed pallet-truck access (no ramp, incline, or bump) that requires very little dedicated floor space; and the consequent unobstructed full access from three sides with the ability to handle standard GMA (Grocery Manufacturers' Association) pallets conventionally from the front and also handle CHEP (Commonwealth Handling Equipment Pool) pallets from either side or from the end.

Figure 16:
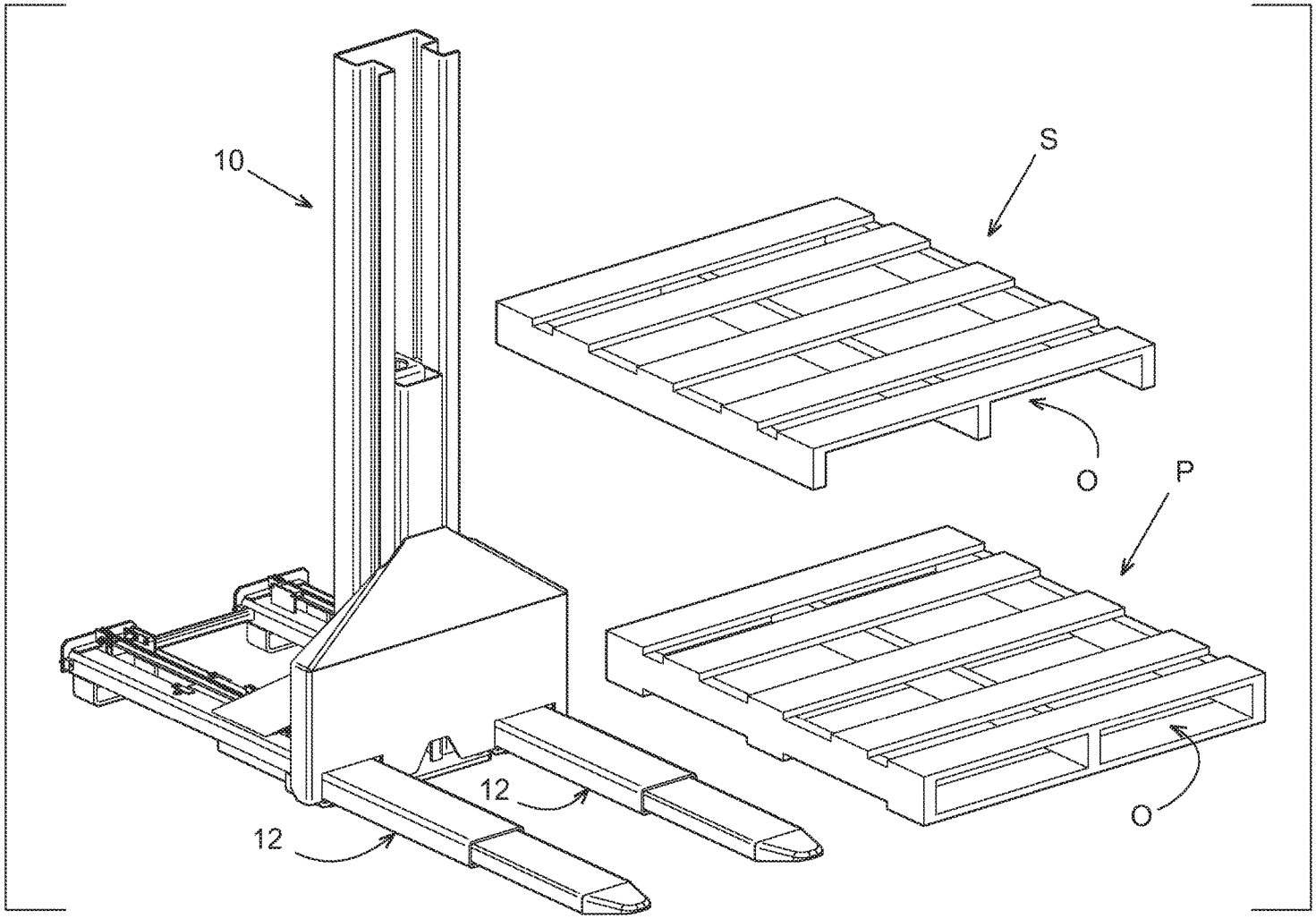
FIG. 16 illustrates a conventional pallet and a skid next to the load elevator of the invention shown with extended forks to show the structures of the pallet and skid in relation to the size and geometry of the forks.
Figure 17:
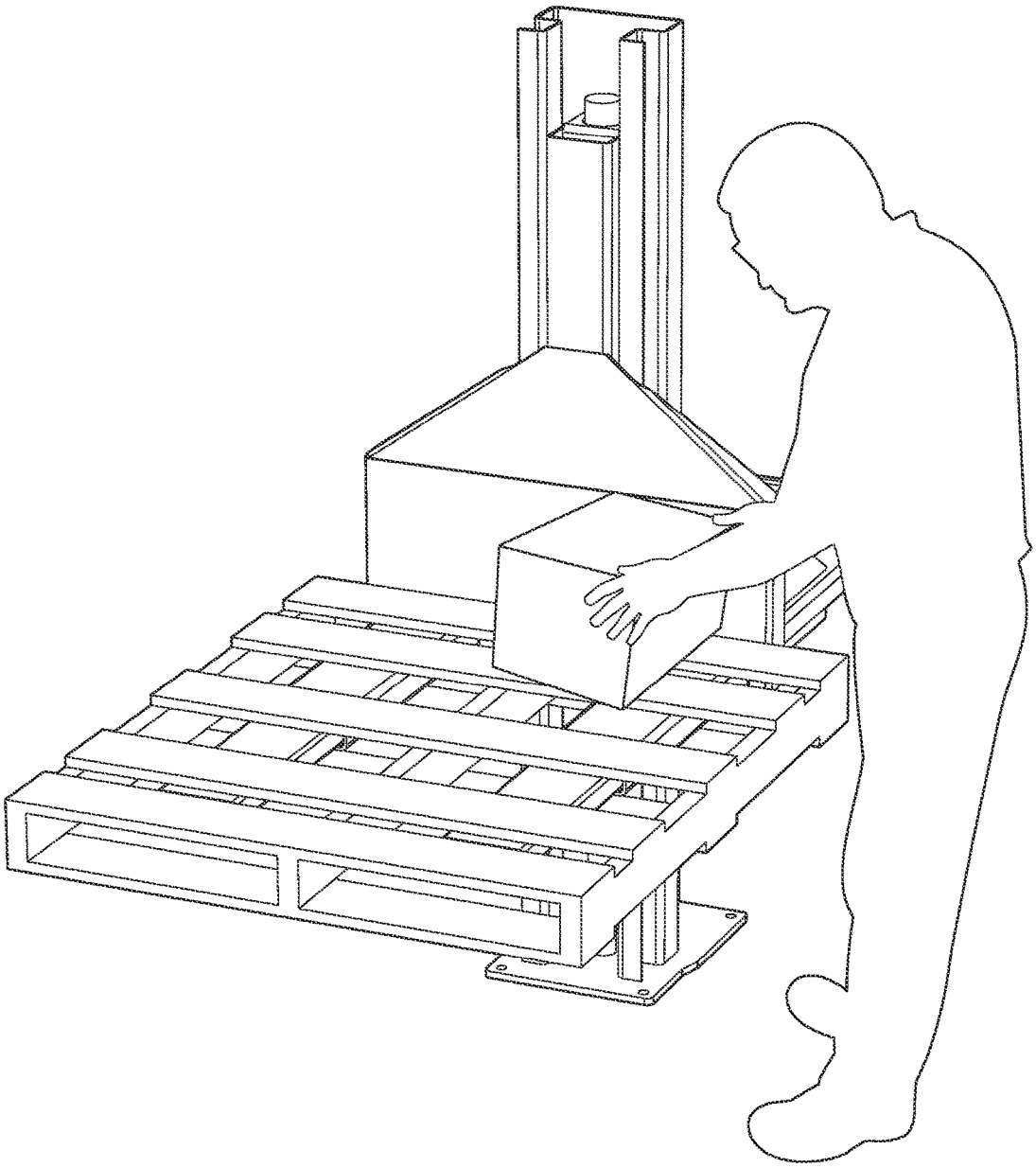
FIG. 17 illustrates an operator handling packages off of a pallet with the load elevator of the invention.

FIG. 16 shows a GMA pallet P and a skid S next to the load elevator 10 of the invention to illustrate the structure of either in relation to the forks 12 of the elevator. Inasmuch as the pallets and skids used in commerce are all substantially the same in shape and size, the forks 12 are advantageously sized and spaced-apart as needed to fit within the openings O under the support platform of both. Note that GMA pallets account for 30% of all new wood pallets produced in the United States and CHEP products constitute a similarly large amount of wood and plastic pallets. FIG. 17 illustrates the safe and ergonomically efficient operating environment the present invention affords to an operator handling packages off of a pallet.

While the invention has been shown and described in what is believed to be the most practical and preferred embodiment, it is recognized that departures can be made therefrom within the scope of the invention. For example, as mentioned, the invention has been described in terms of a hydraulic-lift functionality but it could be implemented with any other mechanism capable of actuation without interference with the space in front of the carriage. It is similarly understood that the invention could be implemented with a self-leveling lift mechanism of the kind described in U.S. Patent Publication No. 2011-0259675. Therefore, the invention is not to be limited to the details disclosed herein, but is to be accorded the full scope of the claims so as to embrace any and all equivalent apparatus and methods.

I claim:

1. A pallet-truck-compatible load elevator comprising:

a vertical mast;

a carriage coupled to the mast with slide blocks that provide a sliding interface for a vertical motion of the carriage along the mast;

a hydraulic cylinder for producing said vertical motion of the carriage along the mast;

a pair of retractable fork assemblies connected to the carriage and entirely housed beyond a front face of the carriage when in retracted position, such that access to said front face of the carriage is unobstructed to a pallet truck carrying a pallet;

wherein each of said fork assemblies includes an outer fork coupled to a support attached to the carriage and an inner fork coupled to the outer fork, the outer fork being movable with respect to said support and the inner fork being movable with respect to said outer fork to provide telescopic horizontal extension and retraction of the fork assemblies;

a back end of the outer fork includes a back roller coupled to said support attached to the carriage;

a bottom surface of the outer fork is supported by a front roller attached to the carriage;

an underside of the inner fork is supported by an interior roller coupled to a front end of the outer folk;

a back end of the inner fork is in slidable contact with an upper interior surface of the outer fork; and a motor-driven chain for extending and retracting the outer fork in relation to said support attached to the carriage and for extending and retracting the inner fork in relation to the outer fork.

2. A pallet-truck-compatible load elevator comprising:

a vertical mast;

a carriage coupled to the mast for a vertical motion of the carriage along the mast, said carriage having a front face facing a loading area for access by a pallet truck carrying a pallet; and a pair of retractable fork assemblies connected to the carriage, said fork assemblies being entirely housed beyond said front face of the carriage when in retracted position, such that access to said front face of the carriage is unobstructed to said pallet truck;

wherein each of said fork assemblies includes an outer fork coupled to a support attached to the carriage and an inner fork coupled to and supported by the outer fork, the outer fork being telescopically movable with respect to said support and the inner fork being telescopically movable with respect to said outer fork to provide telescopic horizontal extension and retraction of the fork assemblies, wherein inner and outer refer to a relative radial position of the forks within each assembly.

3. The elevator of claim 2, wherein a back end of the outer fork includes a back roller coupled to said support attached to the carriage;

a bottom surface of the outer fork is supported by a front roller attached to the carriage;

an underside of the inner fork is supported by an interior roller coupled to a front end of the outer fork; and a back end of the inner fork is in slidable contact with an upper interior surface of the outer fork.

4. The elevator of claim 3, further comprising a flexible structure supporting said front roller attached to the carriage, said structure being adapted to flex downward and cause the outer fork to bear against a lower-front pressure plate when the outer fork is extracted and subjected to a downward pressure; and an upper-rear pressure plate attached to the back of the outer fork, said upper-rear pressure plate bearing against a surface of said support attached to the carriage when the outer fork is extracted and subjected to said downward pressure.

5. The elevator of claim 4, further comprising a flexible beam supporting said interior roller coupled to the front end of the outer fork, said flexible beam being adapted to flex downward and cause the inner fork to bear against an upper-front pressure plate when the inner fork is extracted and subjected to a load.

6. The elevator of claim 5, further comprising a lower-rear pressure plate attached to the back of the inner fork for slidable connection with the outer fork.

7. The elevator of claim 4, wherein said support attached to the carriage includes an angle-guide structure and said upper-rear pressure plate bears against a surface of said angle-guide structure when the outer fork is extracted and subjected to said downward pressure.

8. The elevator of claim 2, further including a mechanism for extending and retracting the outer fork in relation to said support attached to the carriage and for extending and retracting the inner fork in relation to the outer fork.

9. The elevator of claim 8, wherein said mechanism includes a motor-driven chain attached to the outer fork in closed-loop configuration.

10. The elevator of claim 8, wherein said mechanism includes an extend cable with one end connected to the inner fork and another end connected to the carriage, said extend cable being engaged by an extend pulley attached to the outer fork such that the inner fork is extracted by the outer fork when the outer fork is being extracted; and the mechanism further includes a retract cable with one end connected to the inner fork and another end connected to the carriage, said retract cable being engaged by a retract pulley attached to the outer fork such that the inner fork is retracted by the outer fork when the outer fork is being retracted.

11. The elevator of claim 2, wherein said vertical mast and carriage are coupled by slide blocks that provide a sliding interface for said vertical motion of the carriage along the mast.

12. The elevator of claim 11, further comprising a hydraulic cylinder for producing said vertical motion of the carriage along the mast.

13. The elevator of claim 2, wherein said support attached to the carriage includes an angle-guide structure.

* * * * *